US011299837B2

(12) United States Patent
Cho et al.

(10) Patent No.: US 11,299,837 B2
(45) **Date of Patent: *Apr. 12, 2022**

(54) WASHING MACHINE AND METHOD FOR CONTROLLING WASHING MACHINE

(71) Applicant: Samsung Electronics Co., Ltd., Suwon-si (KR)

(72) Inventors: Hyun Gu Cho, Gwangju (KR); Young Chul Jo, Suwon-si (KR); Koang Hun Ryu, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 162 days.

This patent is subject to a terminal disclaimer.

(21) Appl. No.: 16/733,899

(22) Filed: Jan. 3, 2020

(65) Prior Publication Data

US 2020/0141039 A1 May 7, 2020

Related U.S. Application Data

(63) Continuation of application No. 15/307,193, filed as application No. PCT/KR2014/006920 on Jul. 29, 2014, now Pat. No. 10,526,738.

(30) Foreign Application Priority Data

Apr. 30, 2014 (KR) ..... 10-2014-0052552

(51) Int. Cl.
*D06F 33/43* (2020.01)
*D06F 37/04* (2006.01)
(Continued)

(52) U.S. Cl.
CPC ..... *D06F 33/43* (2020.02); *D06F 37/04* (2013.01); *D06F 39/02* (2013.01); *D06F 39/085* (2013.01);
(Continued)

(58) Field of Classification Search
None
See application file for complete search history.

(56) References Cited

U.S. PATENT DOCUMENTS 6,036,241 A 3/2000 Ostdiek
7,921,493 B2 4/2011 Kim
(Continued)

FOREIGN PATENT DOCUMENTS

CN 101646821 2/2010
CN 102108619 6/2011
(Continued)

OTHER PUBLICATIONS

Chinese Office Action dated May 25, 2018 in Chinese Patent Application No. 201480080220.8.
(Continued)

*Primary Examiner* — Rita P Adhlakha
(74) *Attorney, Agent, or Firm* — Staas & Halsey LLP

(57) ABSTRACT

Disclosed herein are a washing machine and a method for controlling a washing machine. The washing machine may include: a body; a tub provided inside of the body to store water; a detergent supply unit disposed adjacent to the tub to supply detergent to the tub during an operating mode for washing laundry and to receive water during a cleaning mode; and a controller configured to allow a cleaning of the detergent supply unit to be performed by controlling a flow of water of the detergent supply unit and the tub during the cleaning mode of the detergent supply unit.
The present disclosure may be possible to keep the washing machine clean by automatically cleaning a detergent supply unit. In addition, it may be possible to improve the quality and the reliability of the product by automatically cleaning a detergent supply unit by using an input.

6 Claims, 15 Drawing Sheets

(51) Int. Cl.

| | |
|---|---|
| ***D06F 39/02*** | (2006.01) |
| *D06F 103/00* | (2020.01) |
| *D06F 103/40* | (2020.01) |
| *D06F 105/02* | (2020.01) |
| *D06F 105/54* | (2020.01) |
| *D06F 105/58* | (2020.01) |
| *D06F 105/60* | (2020.01) |
| *D06F 101/20* | (2020.01) |
| *D06F 39/08* | (2006.01) |

(52) U.S. Cl.
CPC ..... *D06F 2101/20* (2020.02); *D06F 2103/00* (2020.02); *D06F 2103/40* (2020.02); *D06F 2105/02* (2020.02); *D06F 2105/54* (2020.02); *D06F 2105/58* (2020.02); *D06F 2105/60* (2020.02)

(56) References Cited

U.S. PATENT DOCUMENTS

| | | | |
|---|---|---|---|
| 2008/0235880 | A1 | 10/2008 | Kim et al. |
| 2011/0154865 | A1 | 6/2011 | Lee et al. |

FOREIGN PATENT DOCUMENTS

| | | |
|---|---|---|
| CN | 202766855 | 3/2013 |
| EP | 3121324 | 1/2017 |
| KR | 1998-0011399 | 10/1988 |
| KR | 91-11629 | 7/1991 |
| KR | 1995-0014448 | 6/1995 |
| KR | 1999-011529 | 2/1999 |
| KR | 10-0402446 | 10/2003 |
| KR | 10-2007-0088212 | 8/2007 |
| WO | 2008/120935 | 10/2008 |

OTHER PUBLICATIONS

European Office Action dated Apr. 18, 2019 in corresponding European Patent Application No. 14890827.0.
Chinese Notice of Allowance dated Feb. 2, 2019 in corresponding Chinese Patents Application No. 201480080220.8 (2 pages).
European Communication dated Sep. 3, 2018 in European Patent Application No. 14890827.0.
Extended European Search Report dated Nov. 14, 2017 in European Patent Application No. 14890827.0.
International Search Report dated Jan. 26, 2015 in corresponding International Application No. PCT/KR2014/006920.
U.S. Restriction Requirement dated Oct. 1, 2018 in U.S. Appl. No. 15/307,193.
U.S. Office Action dated Dec. 19, 2018, in U.S. Appl. No. 15/307,193.
U.S. Office Action dated Jun. 5, 2019, in U.S. Appl. No. 15/307,193.
Notice of Allowance dated Aug. 29, 2019 in U.S. Appl. No. 15/307,193.
U.S. Appl. No. 15/307,193, filed Oct. 27, 2016, Hyun Gu Cho et al., Samsung Electronics Co., Ltd.

WASHING MACHINE AND METHOD FOR CONTROLLING WASHING MACHINE

CROSS-REFERENCE TO RELATED APPLICATIONS

This application is a continuation of U.S. National Stage application Ser. No. 15/307,193, filed Oct. 27, 2016, which claims the benefit under 35 U.S.C. § 371 of PCT International Patent Application No. PCT/KR2014/006920, filed Jul. 29, 2014, which claims the foreign priority benefit under 35 U.S.C. § 119 of Korean Patent Application No. 10-2014-0052552, filed Apr. 30, 2014, the contents of which are incorporated herein by reference.

TECHNICAL FIELD

Embodiments of the present disclosure relate to a washing machine having a detergent automatic supply unit and a method for controlling the same.

BACKGROUND ART

A washing machine is configured to remove contaminants from laundry by applying energy, e.g. water current, to the laundry, and the washing machine may be classified into a pulsator washing machine, an agitator washing machine and a drum washing machine depending on a method of applying the energy to the laundry.

The pulsator washing machine is configured to perform a washing using a water current by a rotation of a pulsator in a disc shape, the agitator washing machine is configured to perform a washing by rotating a wing-shaped agitator, which is protruded in the center of a washing tub, rightward and leftward, and the drum washing machine is configured to perform a wash by applying an impact by falling the laundry by the rotation of the drum.

The washing machine performs a wash cycle of washing laundry with water containing dissolved detergent, a rinse cycle of washing the laundry with clean water, which does not contain detergent, and a spin cycle of removing water from the laundry.

The washing machine includes a detergent supply unit provided in an upper portion thereof so that detergent is supplied with supplied water during water is supplied to the tub.

The detergent supply unit is built in a front surface unit of the upper portion of the body of the washing machine, and the detergent supply unit includes an accommodation unit formed in the front surface of the body and a detergent container in a withdraw shape and mounted to be inserted into the inside of the body.

The detergent container is divided into a plurality of regions so that a user inputs detergents by classifying the type of the detergent. The detergent container may have a difficulty in the usability in that a user should input a detergent required for the wash every time.

Further, since the detergent container is configured to be withdrawn frontward in the upper portion of the body, it may cause inconvenience to operating an operation panel disposed in the upper portion of the body and it may have a bad influence on the exterior of the washing machine.

Therefore, recently, the washing machine has been equipped with a detergent automatic supply unit so that the detergent is automatically supplied during the wash.

In order to clean the detergent container of the detergent automatic supply unit, it is required that the detergent container is separated from the accommodation unit of the body. However, since the detergent container is not easily separated from the accommodation unit because the detergent container is movably fixed to the inside of the accommodation unit, and since a user is required to put his/her hand to the inside of the accommodation unit to remove foreign materials and residual water by using a rag, after separating the detergent container from the accommodation unit, it is not easy to remove the foreign material and residual water, and thus it is very difficult to clean the detergent automatic supply unit.

In addition, when the detergent automatic supply unit is not cleaned for long time, there may be a possibility of second contaminant due to the decomposition of the foreign material and as a result, there is a problem that the reliability of the product is also reduced Further, it may cause an unnecessary cost when asking a service for cleaning the detergent automatic supply unit.

DISCLOSURE

Technical Problem

Therefore, it is an aspect of the present disclosure to provide a washing machine capable of automatically cleaning a detergent automatic supply unit and a method for controlling the same.

Technical Solution

In accordance with an aspect of the disclosure, a washing machine may include: a body; a tub provided inside of the body to store water; a detergent supply unit disposed adjacent to the tub to supply detergent to the tub during an operating mode for washing laundry and to receive water during a cleaning mode; and a controller configured to allow a cleaning of the detergent supply unit to be performed by controlling a flow of water of the detergent supply unit and the tub during the cleaning mode of the detergent supply unit.

The detergent supply unit may include a detergent storage having a housing fixedly installed in the body; a detergent container placed inside of the housing to store the detergent and provided with an opening; and a cover configured to open and close the opening; and a detergent discharge unit configured to discharge the detergent of the detergent storage based on a command of the controller.

The washing machine may further include a door configured to open and close an inlet formed in the tub; a first detector configured to detect whether the door is closed or not; and a second detector configured to detect whether the detergent container is separated or not, wherein when controlling cleaning the detergent supply unit, the controller determines whether the door is closed, based on a detection signal of the first detector and determines whether the detergent container is separated, based on a detection signal of the second detector, and when it is determined that the door is closed and the detergent container is separated from the housing, the controller controls cleaning of the detergent supply unit.

The washing machine may further include an input configured to receive an input of a cleaning mode for cleaning of the detergent supply unit, wherein the controller controls cleaning of the detergent supply unit when the cleaning mode is input.

The detergent discharge unit may include a first motor configured to allow a first detergent stored in the detergent storage to be discharged and a second motor configured to allow a second detergent stored in the detergent storage to be discharged, wherein the controller controls driving of the first motor and the second motor in order when performing the cleaning.

The washing machine may further include a pump configured to pump water inside of the tub, wherein the controller controls driving of the pump when performing the cleaning.

The washing machine may further include a display configured to display information, wherein the controller controls the display so that preparation information for preparing the cleaning is displayed on the display prior to performing the cleaning of the detergent supply unit.

In accordance with an aspect of the disclosure, a method for controlling a washing machine having a body, a tub, a drum and a detergent supply unit, may include: determining whether a present mode is a cleaning mode of the detergent supply unit; and performing cleaning of the detergent supply unit when the present mode is the cleaning mode.

The method for controlling a washing machine may further include determining whether a door is opened based on a detection signal of a first detector; determining whether a detergent container is separated based on a detection signal of a second detector; and starting cleaning the detergent supply unit when it is determined that the door is closed and the detergent container is separated from a housing.

The determining whether the present mode is a cleaning mode may include determining whether a cleaning mode is input on an input.

The determining whether the present mode is a cleaning mode may include determining whether the present time is a cleaning time of the detergent supply unit.

The performing cleaning may include driving a pump configured to pump water in the tub and driving sequentially a first motor, which is configured to discharge a first detergent stored in a detergent storage of the detergent supply unit, and a second motor, which is configured to discharge a second detergent stored in the detergent storage.

The method for controlling a washing machine may further include displaying preparation information prior to cleaning on a display when it is determined to be the cleaning mode.

The preparation information may include supplying water to the tub, supplying water to the detergent supply unit and separation of the detergent container from the housing of the detergent supply unit.

In accordance with an aspect of the disclosure, a washing machine may include: a body; a tub provided inside of the body to store water; a drum rotatably coupled to the inside of the tub; a door configured to open and close an inlet formed on the drum; a connection unit configured to connect one side of the tub to one side of the drum and configured to allow the door to be seated thereon; a detergent supply unit disposed in the connection unit to supply detergent to the tub during an operating mode for washing and to receive water during a cleaning mode; and a controller configured to control a flow of water in the tub and the detergent supply unit during the cleaning mode of the detergent supply unit.

The detergent supply unit may include a detergent storage having a housing fixedly installed in the inside of the connection unit; a detergent container placed inside of the housing to store the detergent and provided with an opening; and a cover configured to open and close the opening; and a detergent discharge unit provided with a first motor configured to discharge a first material stored in the detergent storage and a second motor configured to discharge a second material stored in the detergent storage.

The controller performs a cleaning by alternately driving the first motor and the second motor.

The washing machine may further include a pump configured to pump water in the tub, wherein the controller controls driving of the pump when performing the cleaning.

The washing machine may further include: a first flow path connected to between the tub and the pump to deliver water in the tub to the pump; a detergent flow path connected to between the first flow path and the detergent supply unit to deliver water in the detergent supply unit to the first flow path during the cleaning mode; a second flow path connected to between the tub and the pump to deliver water pumped by the pump to the tub; and a water discharge pipe configured to discharge the water in the tub to the outside.

The washing machine may further include a first detector configured to detect whether the door is closed, wherein, when controlling cleaning of the detergent supply unit, the controller determines whether the door is closed, based on a detection signal of the first detector and controls the cleaning of the detergent supply unit when it is determined that the door is closed.

The washing machine may further include a second detector configured to detect whether the detergent container is separated, wherein, when controlling cleaning of the detergent supply unit, the controller determines whether the detergent container is separated, based on a detection signal of the second detector and controls the cleaning of the detergent supply unit when it is determined that the detergent container is separated from the housing.

Advantageous Effects

In accordance with one aspect of the present disclosure, it may be possible to keep the washing machine clean by automatically cleaning a detergent supply unit. In addition, it may be possible to improve the quality and the reliability of the product by automatically cleaning a detergent supply unit by using an input.

DESCRIPTION OF DRAWINGS

These and/or other aspects of the present disclosure will become apparent and more readily appreciated from the following description of the embodiments, taken in conjunction with the accompanying drawings of which.

BEST MODE

Figure 1:
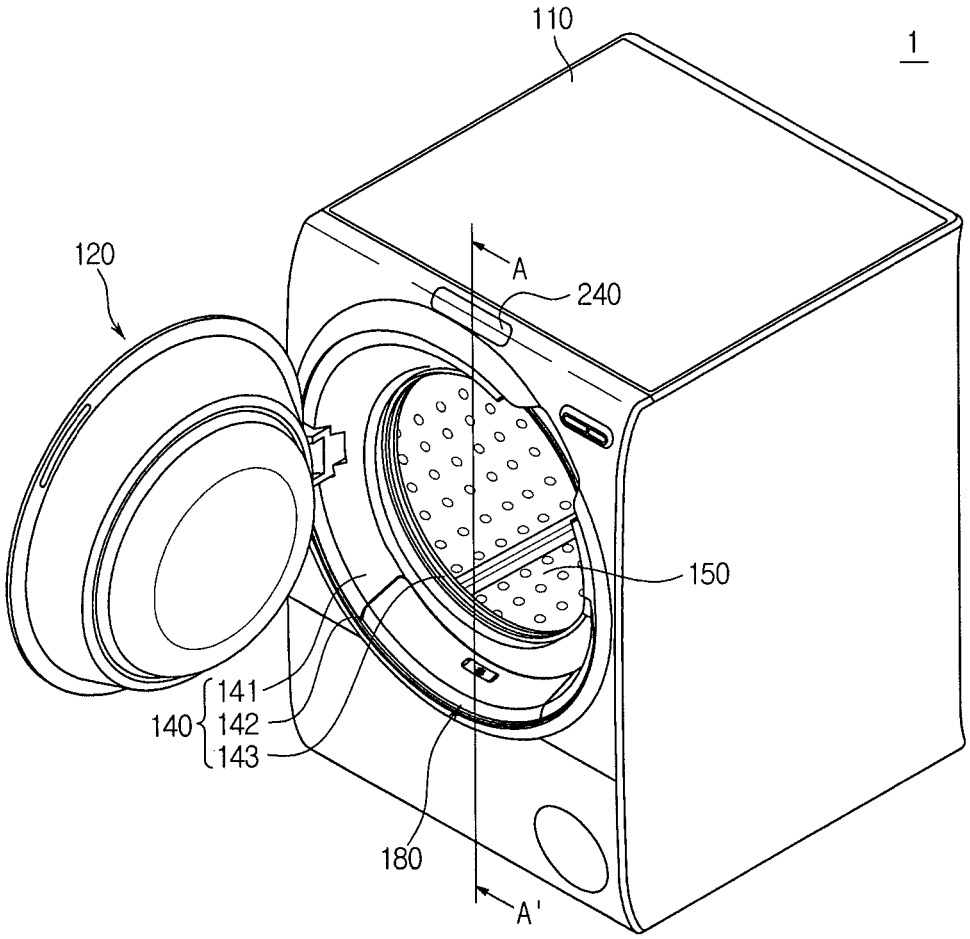
FIG. 1 is a view of a washing machine in accordance with one embodiment of the present disclosure.

Reference will now be made in detail to the embodiments of the present disclosure, examples of which are illustrated in the accompanying drawings, wherein like reference numerals refer to like elements throughout.

Figure 2:
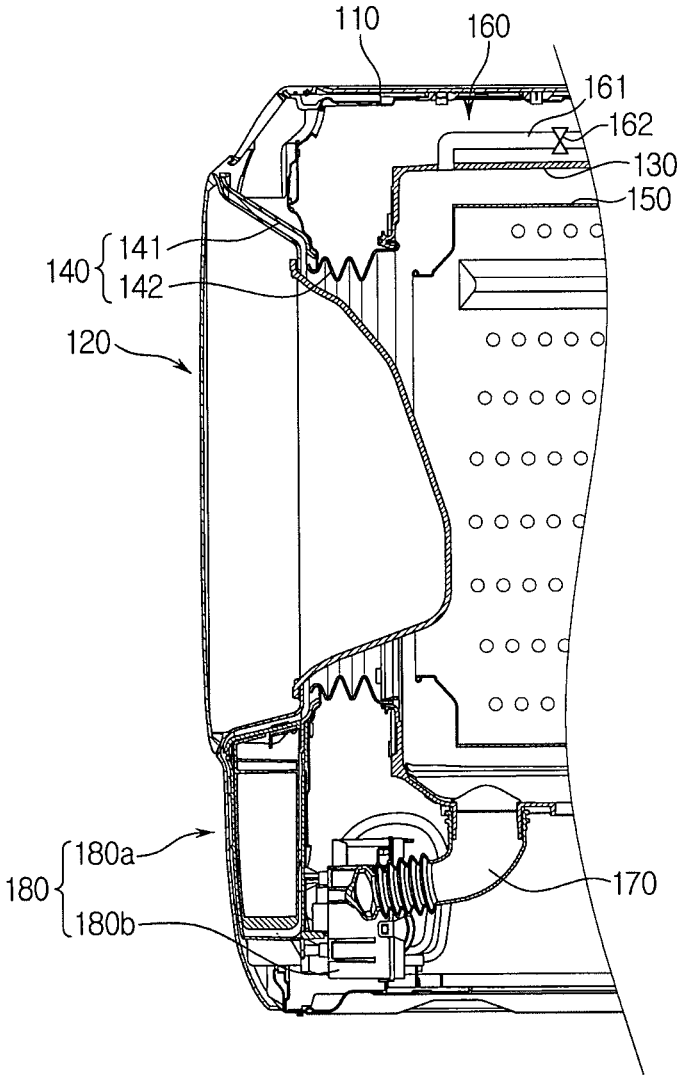
FIG. 2 is a cross-sectional view of the washing machine in accordance with one embodiment of the present disclosure.
Figure 3A:
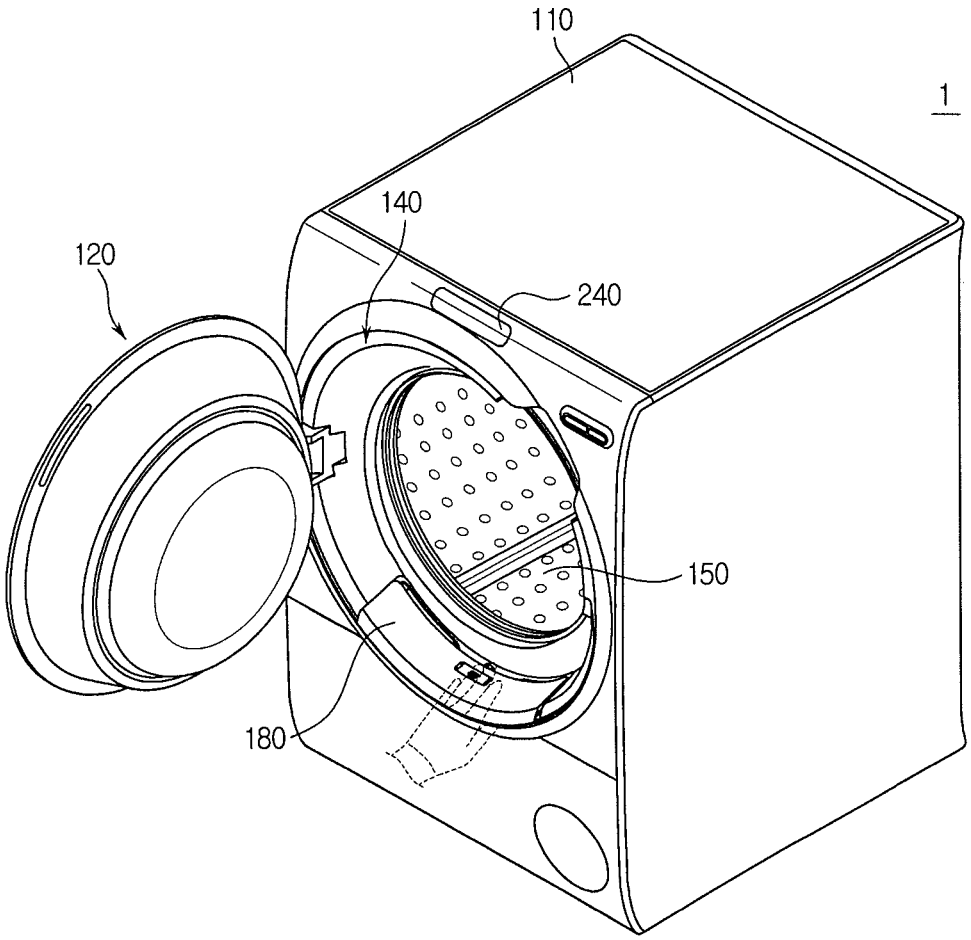
FIGS. 3A and 3B are an exploded view of a detergent supply unit provided in a washing machine in accordance with one embodiment of the present disclosure.
Figure 3B:
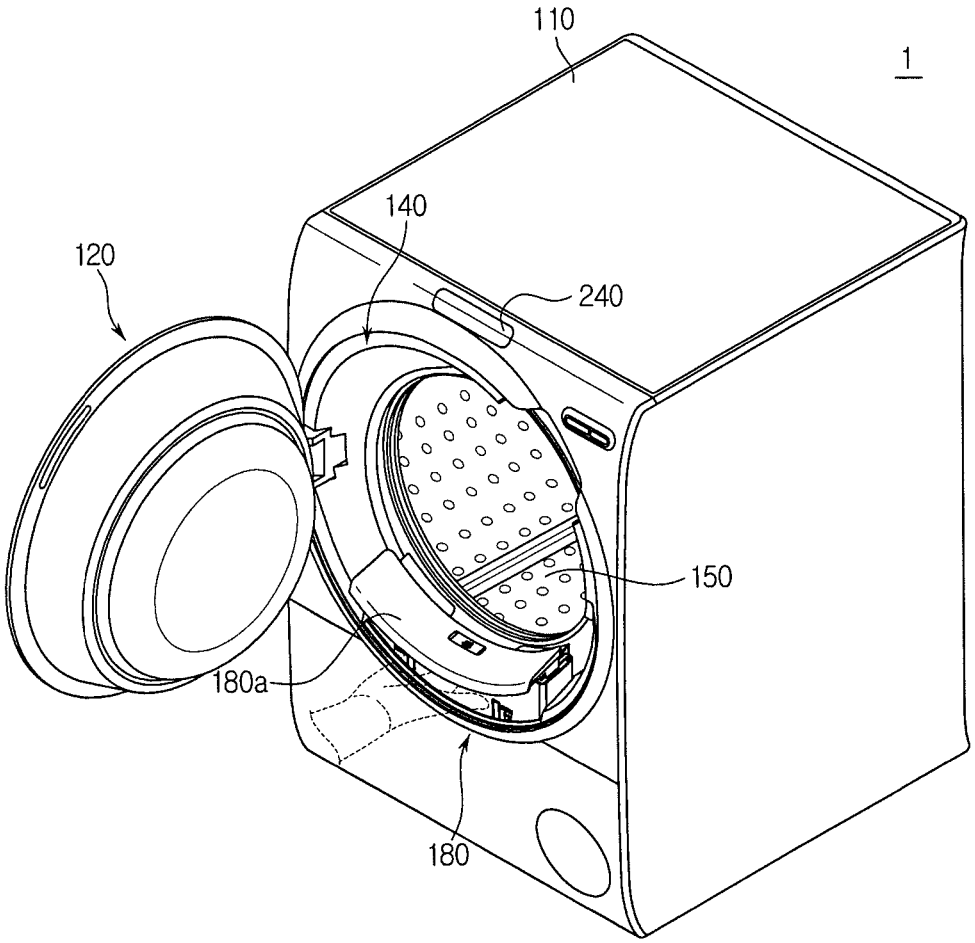

FIG. 1 is a view of a washing machine in accordance with one embodiment of the present disclosure, and FIG. 2 is a cross-sectional view of the washing machine in accordance with one embodiment of the present disclosure. According to one embodiment, the washing machine may include a detergent supply unit and a detail description thereof will be described with reference to FIGS. 3 and 4. FIGS. 3A and 3B are exploded views of a detergent supply unit provided in the washing machine.

A drum washing machine will be described as an example of the washing machine including the detergent supply unit.

A washing machine 1 may perform a washing operation based on a wash course selected by a user, and when a cleaning operation is selected by the user, the washing machine 1 may perform cleaning of the detergent supply unit.

Operation information related to the washing operation may include at least one of information of a wash, a rinse, a spin and a dry cycle, at least one specific information of an intensity, a period of time, and a number of time related to at least one cycle, at least one detergent information of a type and an amount of detergent, and a water temperature.

As illustrated in FIGS. 1 and 2, the washing machine 1 may include a body 110; a door 120; a tub 130; a connection unit 140; a drum 150; a water supply unit 160: a water discharge unit 170; a detergent supply unit 180 and a flow path unit 190.

The body 110 may form an exterior of the washing machine 1 and an inlet may be formed on one side of thereof to put into or to withdraw laundry. The door 120 configured to open and close the inlet may be mounted to the body 110, and the connection unit 140 may be provided in a circumference of the inlet to connect the body 110 to the tub 130.

The door 120 may include a door frame forming an exterior thereof; and a door glass coupled to a rear side of the door frame to be inserted to the inside of the body 110.

The door glass may be transparent to see the inside of the drum 150 so that a user makes sure the washing process with his/her own eyes.

The tub 130 may be fixedly installed inside of the body 110 to store washing water supplied from the water supply unit 160. A motor for the drum (not shown) may be mounted to between the inside of the body 110 and the outside of the tub 130 to rotate the drum 150.

The connection unit 140 may include a door seating unit 141 extended from one surface of the body to the inside of the body to allow the door 120 to be placed; and a gasket 142 installed between the door seating unit 141 and the tub 130 to seal between the door seating unit 141 and the tub 130.

The door seating unit 141 may be inclined from the front surface of the body 110 to the rear side of the body 110, i.e., a direction toward the tub 130 and the drum 150.

An accommodation unit 143 may be provided in the door seating unit 141 to be recessed to the inside of the body 110. The detergent supply unit 180 configured to automatically supply detergent may be placed in the accommodation unit 143.

The drum 150 having a shape corresponding to the tub 130 may be placed inside of the tub 130.

In the outside of the drum 150, a rotational axis (not shown) may be mounted, and the rotational axis may be extended outward of the tub 130 and then connected to a motor (not shown) mounted to the outside of the tub 130. Accordingly, the drum 150 may be rotated clockwise and counterclockwise in the tub 130.

One side of the drum 150 may be opened to form the inlet and when the door 120 is opened, the drum 150 may receive the laundry that is inserted via the inlet.

A plurality of holes may be formed in the rest side of the drum 150 and washing water in the tub may flow to the inside of the drum 150 via the plurality of holes or washing water in the drum may be discharged to the tub via the plurality of holes.

Further, the motor for the drum (not shown) may be rotated when detecting a weight of the laundry and when performing the wash cycle, the rinse cycle and the dry cycle. The motor for the drum (not shown) may rotate the drum 150 using the torque by the rotation itself to allow the laundry placed in the drum 150 to be washed, rinsed, spun and dried The water supply unit 160 may include a water supply pipe 161 connected to a water tap pipe (not shown) to supply the water supplied from the water tap pipe (not shown) to the inside of the tub; and a water supply valve 162 installed in the water supply pipe 161 and configured to allow the water flowing through the water supply pipe 161 to be supplied or to be stopped.

The water discharge unit 170 may include a water discharge pipe 171 connected to the tub 130, particularly connected to a lower side of the tub 130; and a first pump 172 connected to the water discharge pipe 171.

When the first pump 172 is driven, the water discharge pipe 171 may allow the washing water to be discharged to the outside such that the washing water in the tub 130 is introduced and the introduced washing water is guided to the outside.

The first pump 172 may be configured to pump the washing water in the tub 130 and the drum 150 to allow the pumped washing water to be discharged to the outside or to be circulated to the inside of the tub 130, during the wash, rinse, and spin cycle.

The water discharge unit 170 may include a flow path switching unit (not shown) configured to circulate or discharge the pumped washing water. As a result, the flow path switching unit may allow the washing water to flow to the tub or the water discharge pipe by switching the flow path in which the washing water flows.

Further, in the washing machine, a pump configured to circulate washing water and a pump configured to discharge washing water may be individually provided.

The detergent supply unit 180 may store detergent that is inserted by the user and automatically supply the detergent during the wash and rinse cycle.

By placing the detergent supply unit 180, which is configured to store and automatically supply detergent and fabric softeners, in a lower portion of the front side of the body 110, the user's convenience may be improved and the utilization of the upper portion of the body 10 may be enhanced The detergent supply unit 180 may be disposed in the connection unit 140 disposed between the body 110 and the tub 130, particularly disposed in the accommodation unit 143 formed in the door seating unit 141, and configured to be withdrawable to the outside.

As illustrated in FIGS. 3A and 3B, the detergent supply unit 180 may be coupled to the accommodation unit such that the detergent supply unit 180 is slidable in upward and downward.

As a result, the detergent supply unit 180 may be slidable to upward to be withdrawn to the outside of the accommodation unit 143 or slidable to downward to be inserted into the inside of the accommodation unit 143.

The detergent supply unit 180 may be withdrawn in a manual or automatic manner, and when the detergent supply unit 180 is withdrawn in the automatic manner, the detergent supply unit 180 may include a button to receive a withdraw command from a user.

The detergent supply unit 180 may include a detergent storage 180*a* to store at least one of synthetic detergent, fabric softeners, and bleach and a detergent discharge unit 180*b* to discharge the detergent stored in the detergent storage 180*a*.

A detail description of the detergent supply unit will be described later.

The washing machine may further include the flow path unit 190 connected to between the tub 130 and the first pump 172 of the water discharge unit and configured to guide the pumped water to the inside of the tub 130, to discharge the water in the tub 130 to the outside and to guide the detergent of the detergent supply unit 180 to the tub 130. A detail description thereof will be described with reference to FIG. 4.

Figure 4:
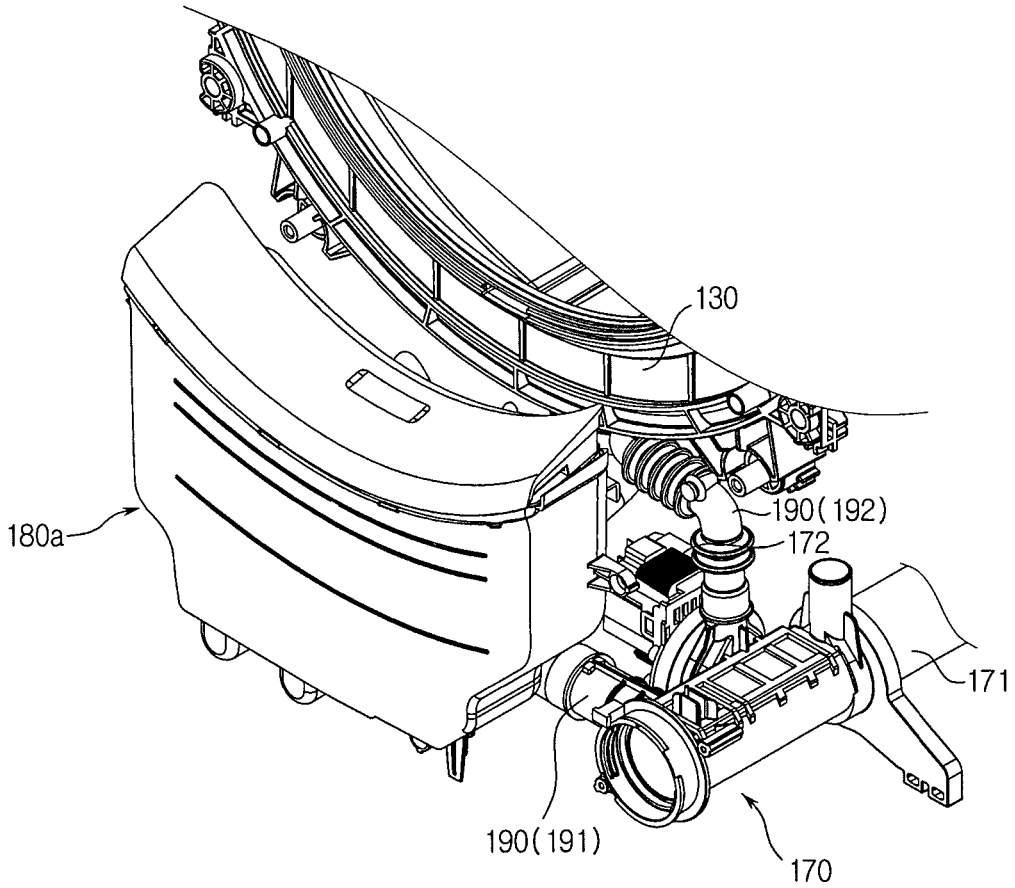
FIG. 4 is a view of a detailed configuration of the flow path unit and the water discharge unit connected to the flow path unit provided in the washing machine in accordance with one embodiment.

FIG. 4 is a view of a detailed configuration of the flow path unit 190 and the water discharge unit 170 connected to the flow path unit 190 provided in the washing machine in accordance with one embodiment.

As illustrated in FIG. 4, the flow path unit 190 may include a first flow path 191 to guide the washing water from the tub 130 to the first pump 172 of the water discharge unit; and a second flow path 192 to guide the washing water from the first pump 172 of the water discharge unit to the tub 130.

The first flow path 191 of the flow path unit 190 may be connected to the tub 130 to receive the washing water discharged from the tub 130 and to guide the received washing water to the second flow path 192 or the water discharge pipe 171.

Accordingly, the washing machine may guide the washing water of the first flow path to the second flow path 192 during the wash and rinse cycle, and guide the washing water of the first flow path to the water discharge pipe 171 after the wash, rinse, and spin cycle are completed.

In addition, the first flow path 191 may be connected to the detergent supply unit 180 to receive the detergent discharged from the detergent supply unit 180.

In this time, the detergent supplied to the first flow path 191 may be mixed with the washing water discharged from the tub 130 and then moved to the second flow path 192 by pumping of the first pump 172.

The second flow path 192 may be connected to the tub and the first pump 172 to receive the washing water and the detergent pumped by the first pump 172 to guide the washing water and the detergent to the tub 130.

Further, the flow path unit 190 may further include a third flow path 193 divaricated from the first flow path 191 and then connected to the tub 130 and provided with a water level detector (not shown) configured to detect a level of an amount of the washing water in the tub 130.

The configuration of the flow path unit 190 will be described together with the configuration of the detergent supply unit 180 with reference to FIGS. 5 to 7.

Figure 5:
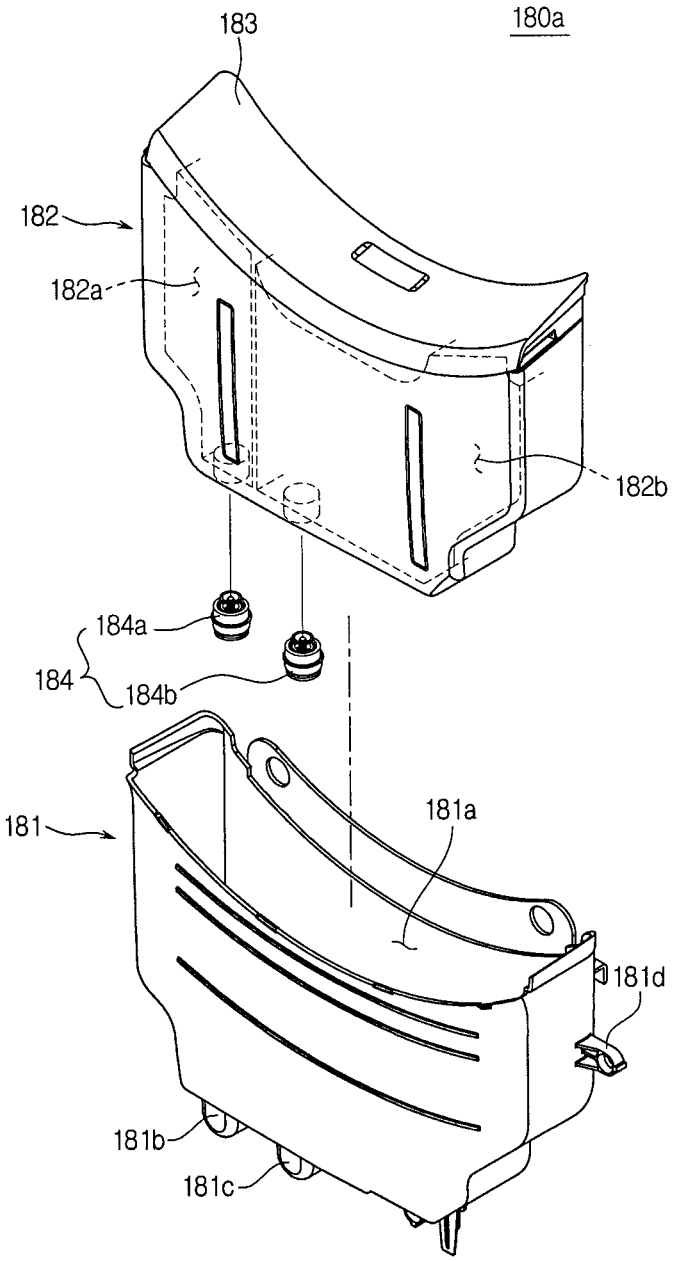
FIG. 5 is an exploded view of the detergent storage of the detergent supply unit provided in the washing machine in accordance with one embodiment of the present disclosure.
Figure 6:
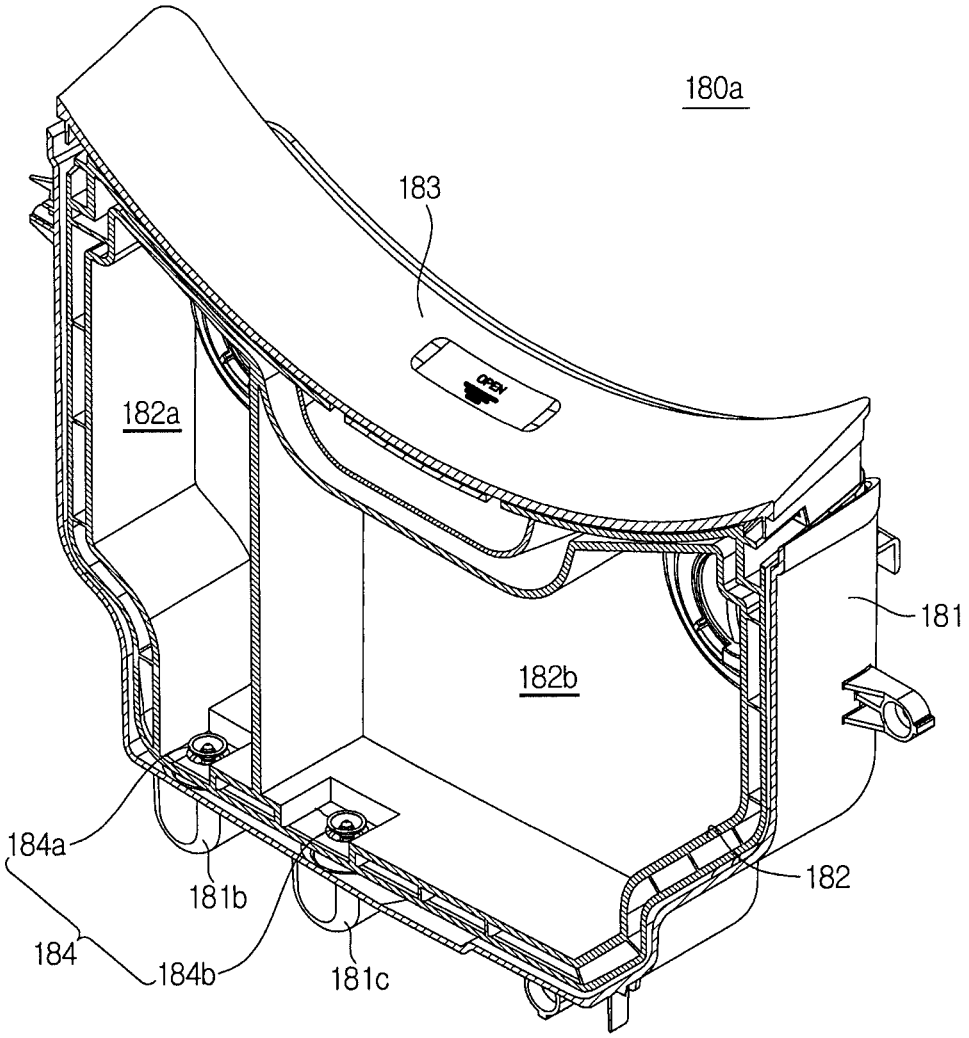
FIG. 6 is a coupling view of the detergent storage of the detergent supply unit provided in the washing machine in accordance with one embodiment of the present disclosure.
Figure 7:
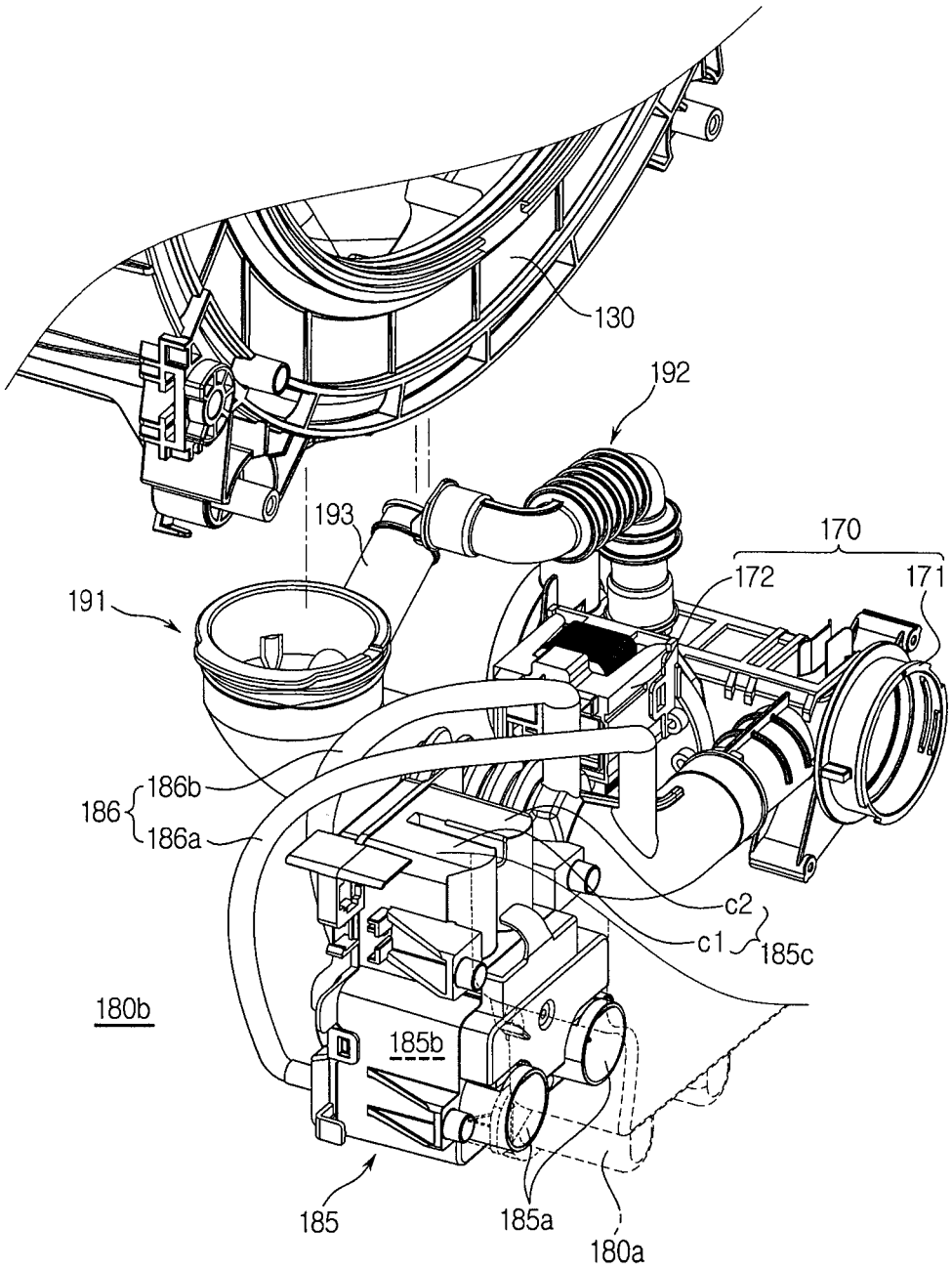
FIG. 7 is a view of the detergent discharge unit of the detergent supply unit provided in the washing machine in accordance with one embodiment of the present disclosure.

FIG. 5 is an exploded view of the detergent storage 180*a* of the detergent supply unit 180 provided in the washing machine, FIG. 6 is a coupling view of the detergent storage 180*a* of the detergent supply unit 180 provided in the washing machine and FIG. 7 is a view of the detergent discharge unit 180*b* of the detergent supply unit 180 provided in the washing machine.

As illustrated in FIGS. 5 and 6, the detergent storage 180*a* of the detergent supply unit 180 may be adjacent to the tub 130 and store at least one of synthetic detergent, fabric softeners, and bleach.

In one embodiment, the detergent storage 180*a* having two compartments to store the synthetic detergent and the fabric softeners will be described as an example.

The detergent storage 180*a* may include a housing 181 placed in the accommodation unit 143 of the door seating unit 141, fixed to the inside of the accommodation unit 143 and provided with an opening; a detergent container 182 formed in a shape identical to the housing 181 to be placed inside of the housing 181 to be withdrawable to the outside and provided with an opening; a cover 183 provided in the opening of the detergent container 182 to open and close the opening of the detergent container; and a plurality of discharge member 184 disposed between the housing 181 and the detergent container 182 to regulate discharging the detergent in the detergent container 182.

Particularly, the housing 181 may include an accommodation space 181*a* to accommodate the detergent container 182; a plurality of reservoirs 181*b* and 181*c* to correspond to a position of the plurality of the discharge member 184 to store each detergent discharged via the plurality of the discharge member 184 and to guide the stored detergent to the detergent discharge unit 180*b*; and a fixation unit 181*d* to fix the housing 181 to the accommodation unit 143 of the door seating unit 141.

The plurality of reservoirs may include a first reservoir 181*b* to store liquid detergent and a second reservoir 181*c* to store fabric softeners.

The fixation unit 181*d* may include a fixation hole to allow a screw-coupling.

Further, a mounting detector (not shown) may be installed on the housing 181 to detect whether the detergent container 182 is coupled to the housing 181 or not and whether the detergent container 182 is coupled to the housing 181 may be displayed on a display 240.

The detergent container 182 may be placed in the accommodation space 181*a* of the housing 181 to be withdrawable to the outside in a sliding manner.

An inner space of the detergent container 182 may be divided by a partition and have two storage rooms by the partition.

As a result, the detergent container 182 may include a first storage room 182*a* in which the liquid detergent for the wash is stored and a second storage room 182*b* in which the fabric softener for the rinse is stored. On a lower surface of the first storage room 182*a* and second storage room 182*b*, a discharge hole to discharge the detergent may be formed, wherein a plurality of discharge member 184 is inserted into the discharge hole.

A first discharge member 184*a* may be inserted into the discharge hole of the first storage room 182*a*, and a second discharge member 184*b* may be inserted into the discharge hole of the second storage room 182*b*.

The detergent container 182 may include a detergent confirming window (not shown) formed to be transparent to check the remaining amount of detergent and the fabric softener by the user.

Further the detergent container 182 may further include a detergent detector (not shown) configured to detect the amount of detergent and the fabric softener and the amount of the detergent and the fabric softener may be displayed on the display 240.

The first discharge member 184*a* may control ON and OFF of discharging the liquid detergent and the amount of discharged liquid detergent stored in the first storage room 182*a* and deliver the discharged liquid detergent to the first reservoir 181*b*, and the second discharge member 184*b* may control ON and OFF of discharging the fabric softener and the amount of discharged fabric softener stored in the second storage room 182*b* and deliver the discharged fabric softener to the second reservoir 181*c*.

As illustrated in FIG. 7, the detergent discharge unit 180*b* of the detergent supply unit may be installed to be communicated with the first reservoir 181*b* and the second reservoir 181*c* to receive the detergent and the fabric softener from the housing 181, and the detergent discharge unit 180*b* of the detergent supply unit 180 may be connected to the first flow path 191 to supply the detergent and the fabric softener.

The detergent discharge unit 180*b* may include a second pump 185 to pump the detergent stored in the reservoirs 181*b* and 181*c* of the detergent storage 180*a*; and a plurality of detergent flow path 186: 186*a* and 186*b* to guide the detergent pumped by the second pump 185 to the first flow path 191.

The plurality of detergent flow path 186 may include a first detergent flow path 186*a* to guide the liquid detergent and a second detergent flow path 186*b* to guide the fabric softener.

The second pump 185 may include a plurality of chambers 185*a* connected to the first reservoir 181*b* and the second reservoir 181*c*; a plurality of piston member 185*b* configured to apply a pressure to each chamber 185*a*; and a plurality of motors 185*c*: c1 and c2 configured to driver each of the piston member 185*b*.

The second pump 185 may include a gear member (not shown) to connect the plurality of motors 185*c*: c1 and c2 and the piston member 185*b*.

The plurality of chambers 185*a* may include a first chamber connected to the first reservoir 181*b*; and a second chamber connected to the second reservoir 181*c*. Accordingly, the first chamber may receive the liquid detergent stored in the first reservoir 181*b* and the second chamber may receive the fabric softener stored in the second reservoir 181*c*.

The plurality of piston member 185*b* may include a first piston member to compress the first chamber and a second piston member to compress the second chamber.

The plurality of motors 185*c* may include a first motor c1 to drive the first piston member and a second motor c2 to drive the second piston member, and a pair of the gear member may be provided.

In the first and second chamber, the first piston member and the second piston member may be moved upward and downward by the drive of the first motor and the second motor to regulate an internal pressure of the first and second chamber so that the detergent stored in the first chamber and the fabric softener stored in the second chamber are discharged through the first detergent flow path 186*a* and the second detergent flow path 186*b*, respectively.

Accordingly, the liquid detergent stored in the first reservoir 181*b* may be moved to the first chamber due to the change in the internal pressure of the first chamber and the liquid detergent of the first chamber may be discharged to the first detergent flow path 186*a* so that the liquid detergent discharged via the first detergent flow path 186*a* may be supplied to the first flow path 191.

The fabric softener stored in the second reservoir 181*c* may be moved to the second chamber due to the change in the internal pressure of the second chamber and the fabric softener of the second chamber may be discharged to the second detergent flow path 186*b* so that the fabric softener discharged via the second detergent flow path 186*b* may be supplied to the first flow path 191.

Further, the first motor and the second motor may regulate the amount of detergent and fabric softener stored in the detergent supply unit 180 based on the number and the period of time of rotation thereof.

When cleaning the detergent supply unit, a route of water supplied to the housing by the user may be the same as a discharge route of the detergent and fabric softener.

That is, during the wash cycle, the liquid detergent discharged to the first flow path 191 may be moved to the first pump 172 together with the washing water discharged from the tub 130 and then supplied to the tub 130 via the second flow path 192. During the rinse cycle, the fabric softener discharged to the first flow path 191 may be moved to the first pump 172 together with the washing water discharged from the tub 130 and then supplied to the tub 130 via the second flow path 192.

During the wash and rinse cycle, the washing water may be circulated through the first flow path, the second flow path, and the tub by the pumping of the first pump 172, and when the wash, rinse and spin cycles are completed, the washing water may be discharged to the outside by the pumping of the first pump.

During the cleaning mode of the detergent supply unit, water, which is supplied to the housing of the detergent supply unit, may be moved to the first reservoir, the chamber of the second pump, the first detergent flow path, the first flow path, the second flow path and the tub in order, and then moved to the second reservoir, the chamber of the second pump, the second detergent flow path, the second flow path and the tub in order.

Figure 8:
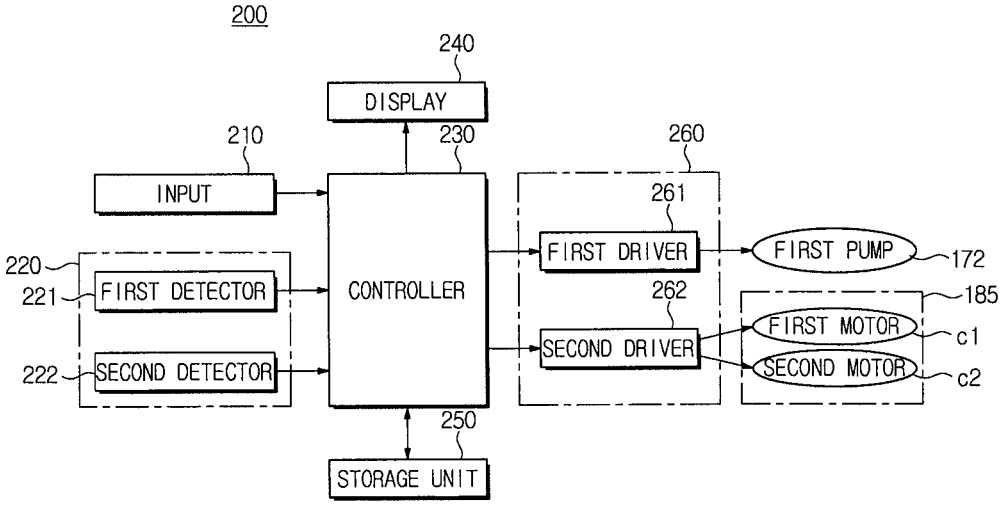
FIG. 8 is a control diagram of the washing machine in accordance with one embodiment

FIG. 8 is a control diagram of the washing machine in accordance with one embodiment, and the washing machine may include a driving module 200 configured to control driving the operating mode to perform the wash, rinse, spin and dry cycle of the washing machine and driving the cleaning mode to perform cleaning the detergent supply unit.

The driving module 200 configured to drive the washing machine may include an input 210; a detector 220; a controller 230; a display 240; a storage unit 250; and a driver 260.

The input 210 may include a jog dial or a plurality of buttons to receive an input of the operating mode for washing the laundry and an input of the cleaning mode for cleaning the detergent supply unit from the user, wherein the operating mode includes a water temperature, a type/amount of detergent, washing course, operation schedule (reservation), additional cycle, and ON/OFF command.

The input 210 may include a touch panel.

The detector 220 may include a first detector 221 provided in the door 120 to detect whether the door 120 is closed or not and a second detector 222 provided in the detergent supply unit 180 to detect whether the detergent container 182 is mounted or not (separation and coupling).

When an operation command is input after inputting operation information such as water temperature, a type/amount of detergent, washing course, operation schedule, and additional cycle, the controller 230 may control an operating mode for washing the laundry based on the input washing operation information.

The controller 230 may control driving of the display 240 so that the display 240 displays an operating mode set by the user, and control driving of the water supply valve 162, the motor for the drum (not shown), the first pump 172 and the second pump 185 based on the operating mode to perform a wash, rinse, spin and dry cycle corresponding to the operating mode.

During the wash cycle, the controller 230 may control the wash cycle by checking the amount of the laundry and then regulating the amount of supplied water based on the checked amount of the laundry. In addition, the controller 230 may determine an input amount of the detergent based on the amount of the laundry and control driving of the first motor of the second pump 185 provided in the detergent supply unit based on the determined input amount of the detergent.

During the rinse cycle, the controller 230 may control the rinse cycle by regulating the amount of supplied water based on the amount of the laundry. In addition, the controller 230 may determine an input amount of the fabric softener based on the amount of the laundry and control driving of the second motor of the second pump 185 provided in the detergent supply unit based on the determined input amount of the fabric softener.

During a discharge cycle after the wash and rinse cycle are completed, the controller 230 may allow the water in the tub to be discharged to the outside by controlling the drive of the first pump 172.

The input amount of the input detergent and fabric softener may be set by a user or determined based on the washing course.

When the cleaning mode is input via the input 210, the controller 230 may control outputting guide information so that the detergent container 182 is separated from the housing 181 of the detergent supply unit 180 and then water is supplied to the housing 181.

"Guide information" may include a text indicating separating the detergent container 182 and supplying water, a picture instructing separating the detergent container 182 and supplying water, and a sound indicating separating the detergent container 182 and supplying water.

The controller 230 may determine whether the door is closed and whether the detergent container 182 is separated, based on a detection signal transmitted from the detector during the cleaning mode. As a result, when it is determined that the detergent container 182 is separated in a state in which the door is closed, the controller 230 may allow the detergent container 182 of the detergent supply unit to be cleaned by controlling the drive of the first pump 172 and the second pump 185.

In this time, the controller 230 may control the first motor c1 of the second pump 185 so that the first motor c1 is rotated for a certain period of time, and when the drive of the first motor c1 is completed, the controller 230 may control the second motor c2 so that the second motor c2 is rotated for a certain period of time.

The order of the drive of the first motor and second motor may be changed and the first motor and second motor may be repeated driven according to the user's selection.

The controller 230 may determine whether the current time is a cleaning time of the detergent supply unit 180 by counting the current time and thus the controller 230 may inform the user a cleaning time of the detergent supply unit 180.

In addition, the controller 230 may count the number of use (the number of washing) and compare the number of use with a predetermined number to determine a cleaning time of the detergent supply unit 180, thereby informing the user the cleaning time of the detergent supply unit 180.

The controller 230 may allow the display 240 to display a cleaning period and a cleaning time.

The display 240 may include at least one of a display panel and light emitting diode (LED), and display an operating mode set by the user, an amount and a type of the detergent, a water temperature, and a cycle, which is currently performed during the washing course.

During the cleaning mode, the display 240 may display cleaning information such as a cleaning method and a cleaning time.

Further, the display 240 may display the cleaning period and the cleaning time of the detergent supply unit based on a command of the controller 230. For example, the display 240 may display that a cleaning period of the detergent supply unit is a month or a cleaning time is tomorrow.

During the cleaning mode of the detergent supply unit, the storage unit 250 may store the cleaning guide information, the driving time of the first and second motor, and the stop time of the first and second motor.

The driving time of the first motor and the driving time of the second motor may be the same with each other or different from each other, and the stop time of the first motor and the stop time of the second motor may be the same with each other or different from each other.

The storage unit 250 may store the number of the washing, which is counted whenever the washing is performed, to determine a cleaning time of the detergent supply unit and initialize the number of use after the cleaning mode is performed.

Further, the storage unit 250 may store the cleaning period or the cleaning time of the detergent supply unit.

The driver 260 may include a first driver 261 to drive the first pump 172; and a second driver 262 to drive the first and second motor of the second pump during the cleaning mode of the detergent supply unit.

The driver 260 may drive the first driver 261 and the second driver 262 based on the control command of the controller 230.

Further, the driver 260 may further include a drum driver to drive the motor for the drum to rotate the drum during the operating mode. The drum driver may transmit a driving signal to the motor for the drum (not shown) in response to an instruction of the controller 230 so that the motor for the drum (not shown) is rotated to rotate the drum 150 when detecting the weight of the laundry, performing the wash, rinse, and spin cycle.

Figure 9:
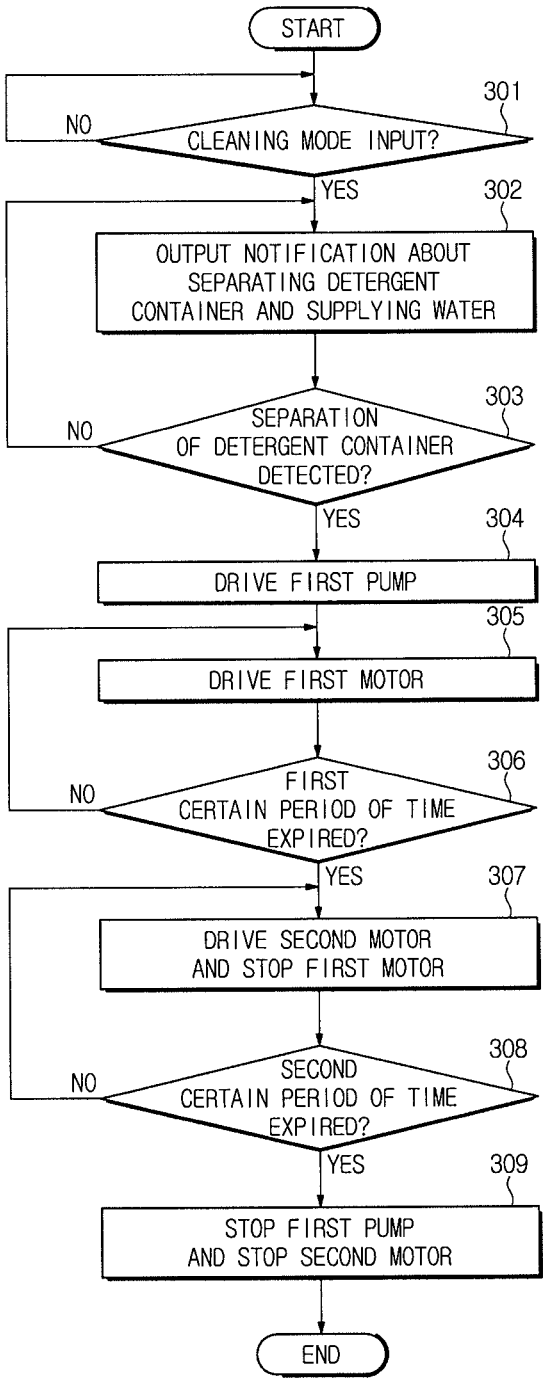
FIG. 9 is a control flowchart of cleaning the detergent supply unit provided in the washing machine in accordance with one embodiment.

FIG. 9 is a control flowchart of cleaning the detergent supply unit provided in the washing machine in accordance with one embodiment.

The washing machine may determine whether a cleaning mode for cleaning the detergent supply unit is input on the input 210 (301).

The washing machine may inform the user the need for cleaning the detergent supply unit by displaying a recommended cleaning time of the detergent supply unit or by outputting a cleaning command for instructing to clean the detergent supply unit.

When it is determined that the cleaning mode is input on the input 210, the washing machine may perform cleaning the detergent supply unit.

The washing machine may output information to prepare the user prior to cleaning the detergent supply unit (302). The preparation information may represent preparation information for cleaning of the detergent supply unit, e.g., supplying water to the inside of the drum, separating the detergent container and supplying water to the housing of the detergent supply unit.

That is, the washing machine may display a text and picture instructing of supplying water to the drum, separating the detergent container and supplying water to the housing of the detergent supply unit, on the display 240 and output a sound instructing of supplying water to the drum, separating the detergent container and supplying water to the housing of the detergent supply unit.

Further, the washing machine may output an amount of water to be supplied to the tub and an amount of water to be supplied to the housing 181 of the detergent supply unit, on the display 240. When the water level detector is provided in the housing of the detergent supply unit, the washing machine may inform the user whether the lack of water in the housing based on a water level detected by the water level detector.

The washing machine may determine whether the detergent container 182 is separated from the housing 181 of the detergent supply unit (303), and when it is determined that the detergent container 182 is placed in the housing 181 of the detergent supply unit, the washing machine may output the instruction of separating the detergent container 182 by the display and a sound unit (not shown), again.

Meanwhile, when it is determined that the detergent container 182 is separated from the housing 181 of the detergent supply unit, the washing machine may pump the water in the tub and the drum by operating the first pump 172 (304).

The pumped water may flow to the first pump along the first flow path 191.

The washing machine may drive the first motor c1 of the second pump 185 (305) so that water in the housing 181 of the detergent supply unit flows along the first discharge member 184*a*, the first reservoir 181*b* and the first detergent flow path 186*a*.

In this time, the first discharge member 184*a*, the first reservoir 181*b* and the first detergent flow path 186*a* may be cleaned by the water of the housing 181, and then the water may be delivered to the first flow path 191.

The washing machine may determine whether a driving time of the first motor exceeds a first certain period of time (306) and when it is determined that a driving time of the first motor exceeds the first certain period of time, the washing machine may stop driving of the first motor c1 of the second pump 185 and drive the second motor c2 (307) so that the water of the housing 181 of the detergent supply unit flows along the second discharge member 184*b*, the second reservoir 181*c*, and the second detergent flow path 186*b*.

In this time, the second discharge member 184*b*, the second reservoir 181*c* and the second detergent flow path 186*b* may be cleaned by the water of the housing 181, and then the water may be delivered to the first flow path 191.

Further, the washing machine may have a predetermined break time after stopping the driving of the first motor c1, and when the predetermined break time is expired, the washing machine may drive the second motor c2.

The washing machine may determine whether a driving time of the second motor exceeds a second certain period of time (308) and when it is determined that a driving time of the second motor exceeds the second certain period of time, the washing machine may stop driving of the second motor c2 of the second pump 185 and stop the first motor c1 (309).

The first certain period of time and the second certain period of time may be the same with each other or different from each other.

The washing machine may additionally drive the first pump for a predetermined discharge time after stopping of driving of the second motor, and when the predetermined discharge time is expired, the washing machine may stop the first pump so that the water used for cleaning the detergent supply unit and the water in the tub are discharged to the outside.

During cleaning the first discharge member 184*a*, the first reservoir 181*b* and the first detergent flow path 186*a* by driving the first motor, the washing machine may determine whether a pause button is input, and when it is determined that the pause button is input, the washing machine may pause the driving of the first motor.

The pause button may be input by a user when foreign materials are stock in the first discharge member 184*a* and the user wants to repeatedly clean the first discharge member 184*a*.

The washing machine may determine whether the pause button is re-input by the user, and when it is determined that the pause button is re-input, the washing machine may additionally drive the first motor for the first certain period of time.

Further, the first motor may be driven for a remaining time obtained by subtracting a driving time from the first certain period time During cleaning the second discharge member 184*b*, the second reservoir 181*c* and the second detergent flow path 186*b* by driving the second motor, the washing machine may determine whether a pause button is input, and when it is determined that the pause button is input, the washing machine may pause the driving of the second motor.

The pause button may be input by a user when foreign materials are stock in the second discharge member 184*b* and the user wants to repeatedly clean the second discharge member 184*b*.

The washing machine may determine whether the pause button is re-input by the user, and when it is determined that the pause button is re-input, the washing machine may additionally drive the second motor for the second certain period of time.

Further, the second motor may be driven for a remaining time obtained by subtracting a driving time from the second certain period time.

The washing machine may alternately drive the first motor and the second motor and particularly drive the first motor and the second motor by a plurality of times. The first motor and the second motor may be alternately driven with having the predetermined break time.

Figure 10:
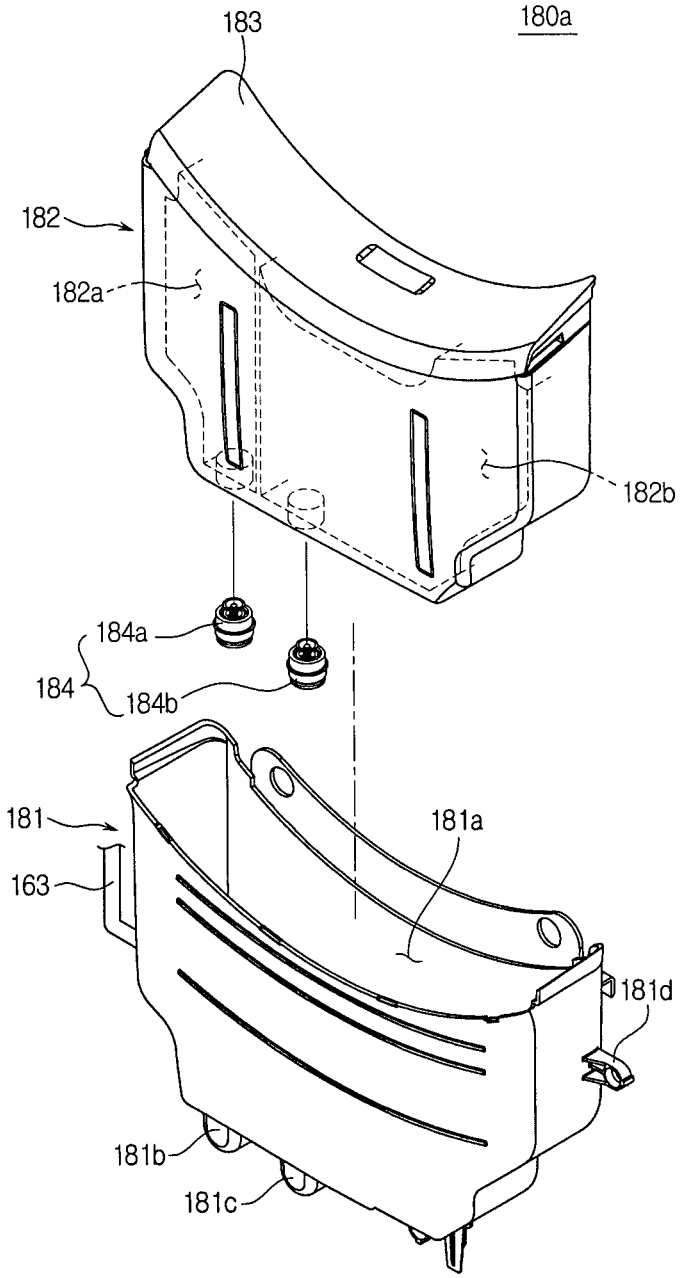
FIG. 10 is an exploded view of a detergent supply unit provided in a washing machine in accordance with another embodiment of the present disclosure.

FIG. 10 is an exploded view of a detergent supply unit provided in a washing machine in accordance with another embodiment of the present disclosure.

A water supply unit 160 may include a water supply pipe 161 connected to a tub 130; and a water supply valve 162 installed in the water supply pipe 161 and configured to supply or stop water to the tub 130 (refer to FIG. 2).

Unlike one embodiment, the water supply unit 160 may further include a second water supply pipe 163 connected to the housing 181 of the detergent supply unit to supply water to the housing 181 of the detergent supply unit.

The water valve may include a three-way valve to regulate the flow of the water supplied to the tub and the housing of the detergent supply unit.

Accordingly, during an operating mode for washing the laundry, the washing machine may supply water to the tub through the first water supply pipe. During a cleaning mode for cleaning the detergent supply unit, the washing machine may supply water to the tub through the first water supply pipe for a predetermined period of time and then supply water to the housing 181 of the detergent supply unit through the second water supply pipe for a predetermined period of time by regulating a flow path of a three-way valve The water supply unit 160 may further include a valve (not shown) disposed in the second water supply pipe 163 and configured to supply water from the second water supply pipe 163 to the housing 181 of the detergent supply unit and to stop supplying water.

The housing 181 of the detergent supply unit may be connected to the second water supply pipe 163 of the water supply unit 160, and during the cleaning mode, the housing 181 may receive water through the second water supply pipe 163 for cleaning.

A driving module may further include a driver to drive the water supply valve. The driver configured to drive the water supply valve may turn on and off the water supply valve 162 in response to an instruction of the controller 230 so that washing water is supplied to the inside of the tub 130 and the drum 150 during the operating mode, and so that the water is supplied to the inside of the tub 130, the drum 150 and the detergent supply unit 180 during the cleaning mode.

According to another embodiment, the washing machine may automatically perform the cleaning mode of the detergent supply unit or manually perform the cleaning mode by the user.

Figure 11:
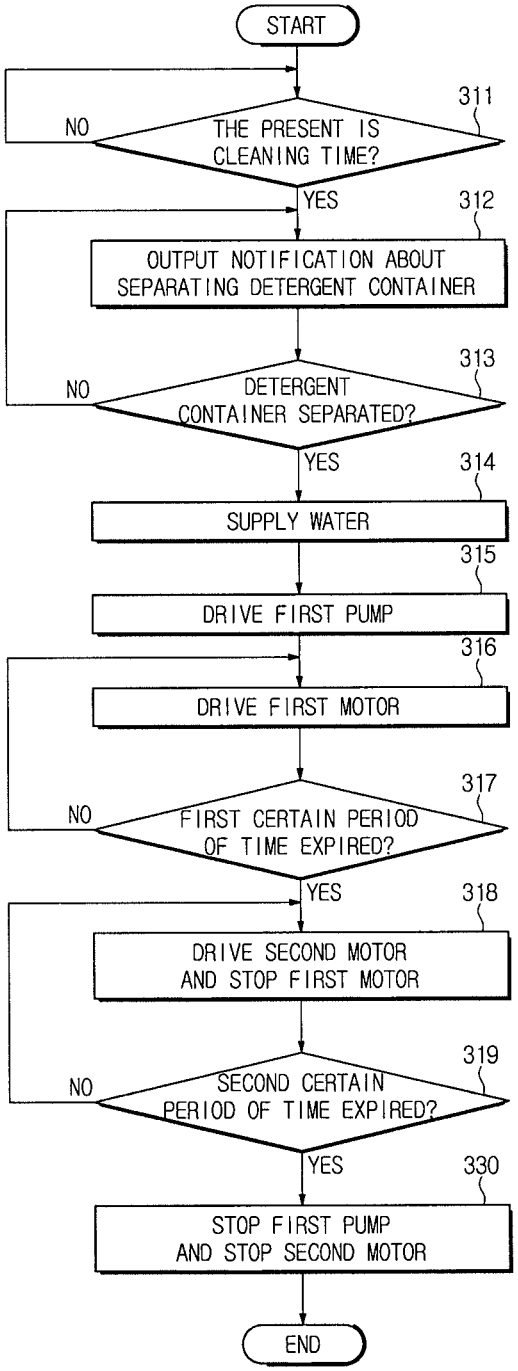
FIG. 11 is a control flowchart of cleaning the detergent supply unit provided in the washing machine in accordance with another embodiment.

FIG. 11 is a control flowchart of cleaning the detergent supply unit provided in the washing machine in accordance with another embodiment.

The washing machine may determine whether the present is a cleaning time of the detergent supply unit (311), and when it is determined that the present is the cleaning time, the washing machine may display that it is the cleaning time.

Determining whether of the cleaning time may include determining the cleaning time based on a predetermined cleaning period and determining the cleaning time based on a predetermined number of the use of the washing machine.

When a command for instructing cleaning of the detergent supply unit is input by the user, the washing machine may output information for cleaning the detergent supply unit, e.g. separating the detergent container, to the user prior to cleaning the detergent supply unit (312).

That is, the washing machine may display a text and picture instructing separating the detergent container on the display 240 and output a sound instructing separating the detergent container.

The washing machine may determine whether the detergent container 182 is separated from the housing 181 of the detergent supply unit (313), and when it is determined that the detergent container 182 is placed in the housing 181 of the detergent supply unit, the washing machine may output the instruction of separating the detergent container by the display and a sound unit (not shown), again.

Meanwhile, when it is determined that the detergent container 182 is separated from the housing 181 of the detergent supply unit, the washing machine may supply the water to the tub and to the housing of the detergent supply unit (314).

Accordingly, the washing machine may control the water supply valve 162 so that the water is supplied to the tub through the first water supply pipe for a first predetermined water supply time, and when the first water supply time is expired, the washing machine may convert a flow path of the water supply valve so that the water is supplied to the housing 181 of the detergent supply unit through the second water supply pipe 163 for a second predetermined water supply time.

In addition, when it is determined that the present is the cleaning time of the detergent supply unit, the washing machine may automatically clean the detergent supply unit without the input of the cleaning command from the user.

The washing machine may pump the water in the tub and the drum by driving the first pump 172 (315). In this time, the pumped water may flow to the first pump along the first flow path 191.

The washing machine may drive the first motor c1 of the second pump 185 (316) so that water in the housing 181 of the detergent supply unit flows along the first discharge member 184*a*, the first reservoir 181*b* and the first detergent flow path 186*a*.

In this time, the first discharge member 184*a*, the first reservoir 181*b* and the first detergent flow path 186*a* may be cleaned by the water of the housing 181 and then the water may be delivered to the first flow path 191.

The washing machine may determine whether a driving time of the first motor exceeds a first certain period of time (317) and when it is determined that a driving time of the first motor exceeds the first certain period of time, the washing machine may stop driving of the first motor c1 of the second pump 185 and drive the second motor c2 (318) so that the water of the housing 181 of the detergent supply unit flows along the second discharge member 184*b*, the second reservoir 181*c*, and the second detergent flow path 186*b*.

In this time, the second discharge member 184*b*, the second reservoir 181*c* and the second detergent flow path 186*b* may be cleaned by the water of the housing 181, and then the water may be delivered to the first flow path 191.

Further, the washing machine may have a predetermined break time after stopping the driving of the first motor c1, and when the predetermined break time is expired, the washing machine may drive the second motor c2.

The washing machine may determine whether a driving time of the second motor exceeds a second certain period of time (319) and when it is determined that a driving time of the second motor exceeds the second certain period of time, the washing machine may stop driving of the second motor c2 of the second pump 185 and stop the first motor c1 (320).

The first certain period of time and the second certain period of time may be the same with each other or different from each other.

The washing machine may additionally drive the first pump for a predetermined discharge time after stopping of driving of the second motor, and when the predetermined discharge time is expired, the washing machine may stop the first pump so that the water used for cleaning the detergent supply unit and the water in the tub are discharged to the outside.

During cleaning the first discharge member 184*a*, the first reservoir 181*b* and the first detergent flow path 186*a* by driving the first motor, the washing machine may determine whether a pause button is input, and when it is determined that the pause button is input, the washing machine may pause the driving of the first motor.

The pause button may be input by a user when foreign materials are stock in the first discharge member 184*a* and the user wants to repeatedly clean the first discharge member 184*a*.

The washing machine may determine whether the pause button is re-input by the user, and when it is determined that the pause button is re-input, the washing machine may additionally drive the first motor for the first certain period of time.

Further, the first motor may be operated for a remaining time obtained by subtracting a driving time from the first certain period time During cleaning the second discharge member 184*b*, the second reservoir 181*c* and the second detergent flow path 186*b* by driving the second motor, the washing machine may determine whether a pause button is input, and when it is determined that the pause button is input, the washing machine may pause the driving of the second motor.

The pause button may be input by a user when foreign materials are stock in the second discharge member 184*b* and the user wants to repeatedly clean the second discharge member 184*b*.

The washing machine may determine whether the pause button is re-input by the user, and when it is determined that the pause button is re-input, the washing machine may additionally drive the second motor for the second certain period of time.

Further, the second motor may be operated for a remaining time obtained by subtracting a driving time from the second certain period time.

The washing machine may alternately drive the first motor and the second motor and particularly drive the first motor and the second motor by a plurality of times. The first motor and the second motor may be alternately driven with having the predetermined break time.

Figure 12:
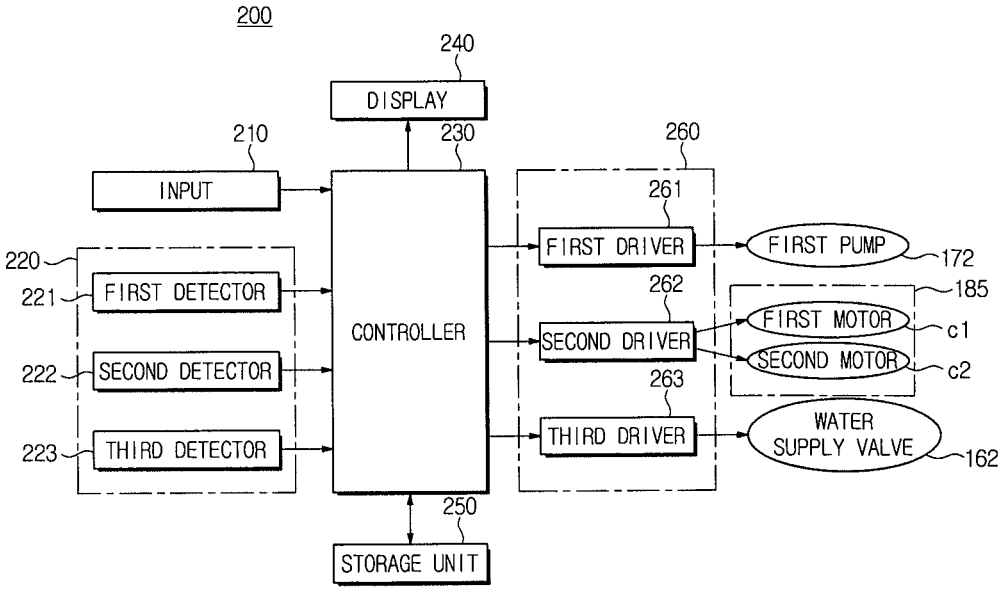
FIG. 12 is a control diagram of a washing machine in accordance with another embodiment, particularly illustrates a component added to one embodiment.

FIG. 12 is a control diagram of a washing machine in accordance with another embodiment, particularly illustrates a component added to one embodiment.

Unlike one embodiment, a driving module of a washing machine according to another embodiment may further include a third detector 223 to detect a water level of a housing of a detergent supply unit, and a third driver 263 to driver a water supply valve.

Unlike one embodiment, during a cleaning mode, a controller 230 according to another embodiment may automatically supply water to the tub and the detergent storage by controlling the water supply valve so that the inside of the housing is cleaned by using the water automatically supplied.

The controller 230 may determine a water level of the housing 181 based on a detection signal transmitted from the third detector 223 when supplying water to the detergent supply unit, and when it is determined that the water level of the housing 181 is a predetermined water level, the controller 230 may stop supplying water by turning off the water supply valve.

Figure 13:
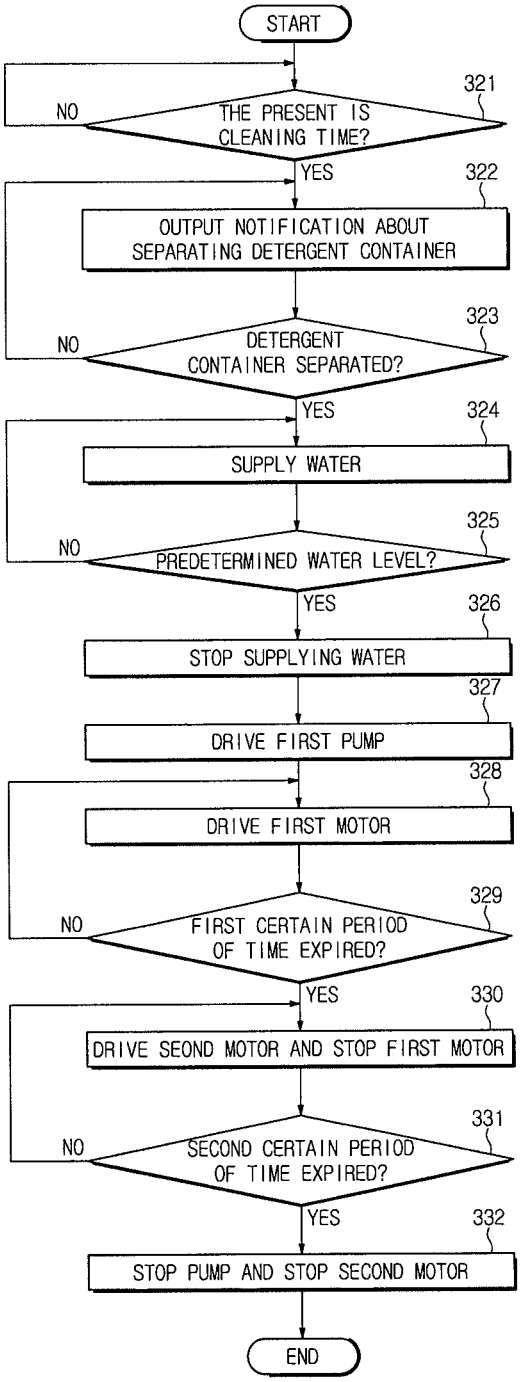
FIG. 13 is a control flowchart of cleaning the detergent supply unit provided in the washing machine in accordance with another embodiment, and a description the same as those shown in another embodiment will be omitted.

FIG. 13 is a control flowchart of cleaning the detergent supply unit provided in the washing machine in accordance with another embodiment, and a description the same as those shown in another embodiment will be omitted.

The washing machine may determine whether the present is a cleaning time of the detergent supply unit (321), and when it is determined that the present is the cleaning time, the washing machine may display that it is the cleaning time.

When a command for instructing cleaning of the detergent supply unit is input by the user, the washing machine may output information for cleaning the detergent supply unit, e.g. separating the detergent container, to the user prior to cleaning the detergent supply unit (322).

That is, the washing machine may display a text and picture instructing separating the detergent container on the display 240 and output a sound instructing separating the detergent container.

The washing machine may determine whether the detergent container 182 is separated from the housing 181 of the detergent supply unit (323), and when it is determined that the detergent container 182 is placed in the housing 181 of the detergent supply unit, the washing machine may output the instruction of separating the detergent container by the display and a sound unit (not shown), again.

Meanwhile, when it is determined that the detergent container 182 is separated from the housing 181 of the detergent supply unit, the washing machine may supply the water to the tub and to the housing of the detergent supply unit (324).

Accordingly, the washing machine may control the water supply valve 162 so that the water is supplied to the tub through the first water supply pipe. In this time, the washing machine may supply water to a predetermined water level by detecting a current water level of the tub.

When supplying water to the tub is completed, the washing machine may temporarily stop supplying water to the tub, and then convert a flow path of the water supply valve so that the water is supplied to the housing 181 of the detergent supply unit through the second water supply pipe 163.

The washing machine may detect a water level of the housing of the detergent supply unit by the third detector and then confirm the water level of the housing based on a detection signal of the third detector. The washing machine may compare the confirmed water level of the housing with a predetermined water level, and when it is determined that the confirmed water level of the housing is the predetermined water level (325), the washing machine may stop supplying water (326).

The washing machine may pump the water in the tub and the drum by driving the first pump 172 (327). In this time, the pumped water may flow to the first pump along the first flow path 191.

The washing machine may drive the first motor c1 of the second pump 185 (328) so that water in the housing 181 of the detergent supply unit flows along the first discharge member 184*a*, the first reservoir 181*b* and the first detergent flow path 186*a*.

In this time, the first discharge member 184*a*, the first reservoir 181*b* and the first detergent flow path 186*a* may be cleaned by the water of the housing 181 and then the water may be delivered to the first flow path 191.

The washing machine may determine whether a driving time of the first motor exceeds a first certain period of time (329) and when it is determined that a driving time of the first motor exceeds the first certain period of time, the washing machine may stop driving of the first motor c1 of the second pump 185 and drive the second motor c2 (330) so that the water of the housing 181 of the detergent supply unit flows along the second discharge member 184*b*, the second reservoir 181*c*, and the second detergent flow path 186*b*.

In this time, the second discharge member 184*b*, the second reservoir 181*c* and the second detergent flow path 186*b* may be cleaned by the water of the housing 181 and then the water may be delivered to the first flow path 191.

Further, the washing machine may have a predetermined break time after stopping the driving of the first motor c1, and when the predetermined break time is expired, the washing machine may drive the second motor c2.

The washing machine may determine whether a driving time of the second motor exceeds a second certain period of time (331) and when it is determined that a driving time of the second motor exceeds the second certain period of time, the washing machine may stop driving of the second motor c2 of the second pump 185 and stop the first motor c1 (332).

The first certain period of time and the second certain period of time may be the same with each other or different from each other.

The washing machine may additionally drive the first pump for a predetermined discharge time after stopping of driving of the second motor, and when the predetermined discharge time is expired, the washing machine may stop the first pump so that the water used for cleaning the detergent supply unit and the water in the tub are discharged to the outside.

During cleaning the first discharge member 184*a*, the first reservoir 181*b* and the first detergent flow path 186*a* by driving the first motor, the washing machine may determine whether a pause button is input, and when it is determined that the pause button is input, the washing machine 1 may pause the driving of the first motor.

The pause button may be input by a user when foreign materials are stock in the first discharge member 184*a* and the user wants to repeatedly clean the first discharge member 184*a*.

The washing machine 1 may determine whether the pause button is re-input by the user, and when it is determined that the pause button is re-input, the washing machine may additionally drive the first motor for the first certain period of time.

Further, the first motor may be operated for a remaining time obtained by subtracting a driving time from the first certain period time.

During cleaning the second discharge member 184*b*, the second reservoir 181*c* and the second detergent flow path 186*b* by driving the second motor, the washing machine may determine whether a pause button is input, and when it is determined that the pause button is input, the washing machine may pause the driving of the second motor.

The pause button may be input by a user when foreign materials are stock in the second discharge member 184*b* and the user wants to repeatedly clean the second discharge member 184*b*.

The washing machine may determine whether the pause button is re-input by the user, and when it is determined that the pause button is re-input, the washing machine may additionally drive the second motor for the second certain period of time.

Further, the second motor may be driven for a remaining time obtained by subtracting a driving time from the second certain period time.

The washing machine may alternately drive the first motor and the second motor and particularly drive the first motor and the second motor by a plurality of times. The first motor and the second motor may be alternately driven with having the predetermined break time.

Figure 14:
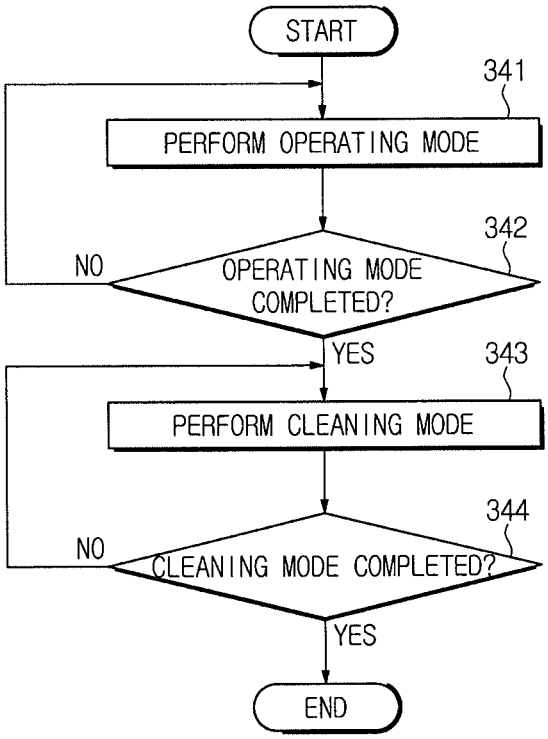
FIG. 14 is a control flowchart of cleaning the detergent supply unit provided in the washing machine in accordance with another embodiment.

FIG. 14 is a control flowchart of cleaning the detergent supply unit provided in the washing machine in accordance with another embodiment.

The washing machine may perform a driving for the washing based on an operating mode selected by a user (341), and the washing machine may determine whether the operating mode for the washing is completed (342).

When it is determined that the operating mode is completed, the washing machine may perform a cleaning mode for cleaning the detergent supply unit (343).

The washing machine may display instructing that the laundry is withdrawn and the detergent supply unit is separated, prior to performing the cleaning mode.

Performing the cleaning mode may be performed by any one method of one embodiment, another embodiment, and yet another embodiment.

The washing machine may receive a cancellation command of cleaning the detergent supply unit. In this time, when the cancellation command of cleaning mode is input after the operating mode is completed, the washing machine may terminate the operation of thereof without performing the cleaning mode.

When the cleaning mode is completed (344), the washing machine may terminate the cleaning mode and output cleaning completion information indicating that the cleaning mode is completed, by at least one of the display and the sound unit.

Although a few embodiments of the present disclosure have been shown and described, it would be appreciated by those skilled in the art that changes may be made in these embodiments without departing from the principles and spirit of the disclosure, the scope of which is defined in the claims and their equivalents.

The invention claimed is:

1. A method for controlling a washing machine having a body, a tub, a drum, and a detergent supply unit, and having an operating mode for washing laundry and a cleaning mode, comprising:

detecting, by a detergent container detector, whether a detergent container of the detergent supply unit is separated from a housing of the detergent supply unit or not separated from the housing of the detergent supply unit;

controlling, by a controller, a flow of water to the detergent supply unit to clean at least the housing based on the washing machine being in the cleaning mode and the detergent container detector detecting the detergent container is separated from the housing; and controlling, by the controller, the flow of water so that the detergent contained in the detergent container is supplied to the tub for washing laundry based on the washing machine being in the operating mode for washing laundry and the detergent container detector detecting the detergent container is not separated from the housing.

2. The method of claim 1 further comprising:

detecting, by a door detector, whether a door is closed or not closed, wherein the controlling, by the controller, the flow of water to the detergent supply unit to clean at least the housing includes:

controlling, by the controller, the flow of water to the detergent supply unit to clean at least the housing, based on the washing machine being in the cleaning mode, the detergent container detector detecting the detergent container is separated from the housing, and the door detector detecting the door is closed.

3. The method of claim 1 further comprising:

determining whether a present mode is the cleaning mode, wherein the determining of whether a present mode is the cleaning mode comprises, at least one of determining whether the cleaning mode is received by an input and determining whether a present time is a cleaning time of the detergent supply unit.

4. The method of claim 1, wherein the controlling, by a controller, a flow of water to the detergent supply unit to clean at least the housing comprises:

driving a pump configured to pump water in the tub and driving sequentially a first motor, which is configured to discharge a first detergent stored in a detergent storage of the detergent supply unit, and a second motor, which is configured to discharge a second detergent stored in the detergent storage.

5. The method of claim 4, further comprising:

displaying preparation information prior to cleaning on a display when it is determined to be the cleaning mode.

6. The method of claim 5 wherein the preparation information comprises:

supplying water to the tub, supplying water to the detergent supply unit and separation of the detergent container from the housing of the detergent supply unit.

* * * * *